US006458037B1

(12) United States Patent
Dixon, Jr.

(10) Patent No.: US 6,458,037 B1
(45) Date of Patent: Oct. 1, 2002

(54) SELF-TRAINING BATTING PRACTICE MACHINE

(76) Inventor: Nicholas E. Dixon, Jr., 4007 Neyman Rd., Albertville, AL (US) 35950

( * ) Notice: Subject to any disclaimer, the term of this patent is extended or adjusted under 35 U.S.C. 154(b) by 0 days.

(21) Appl. No.: 09/631,079

(22) Filed: Aug. 2, 2000

(51) Int. Cl.[7] ..... A63B 69/00
(52) U.S. Cl. ..... 473/219; 473/422; 473/431
(58) Field of Search ..... 473/219, 226, 473/422, 423, 425, 430, 431, 436, 451, 457, 467, 508, 103, 108

(56) References Cited

U.S. PATENT DOCUMENTS

| | | | | |
|---|---|---|---|---|
| 1,962,087 | A | * | 6/1934 | Cone |
| 3,333,847 | A | * | 8/1967 | Pennington |
| 3,994,494 | A | * | 11/1976 | Kelley |
| 4,938,478 | A | * | 7/1990 | Lay |
| 4,966,367 | A | * | 10/1990 | Oyarzabal |
| D314,047 | S | * | 1/1991 | Wang |
| 5,340,101 | A | * | 8/1994 | Lawson |
| 5,531,438 | A | * | 7/1996 | Corley |
| 5,588,646 | A | * | 12/1996 | Dickson |
| 5,618,039 | A | * | 4/1997 | Tsai |
| 6,099,419 | A | * | 8/2000 | Incaudo |
| 6,296,582 | B1 | * | 10/2001 | Minniear |
| 6,306,050 | B1 | * | 10/2001 | Holder |

* cited by examiner

*Primary Examiner*—Benjamin H. Layno
*Assistant Examiner*—Vishu K Mendiratta
(74) *Attorney, Agent, or Firm*—Flanagan & Flanagan; John R. Flanagan

(57) ABSTRACT

A self-training batting practice machine includes an upright support member, lower and upper support members, flexible ball suspension rod and at least one elastic member. The lower support member is attached to the upright support member close to a lower end thereof and extends horizontally outwardly therefrom. The upper support is supported on an upper end of the upright support member such that the upper support member is rotatable about a vertical pivot axis. The ball suspension rod is secured at an inner end to and rotatable with the upper support member and extends substantially horizontally outwardly therefrom and at an outer end has a ball-shaped object thereon for a player to swing a bat at and to hit in order to practice batting. The elastic member is disposed exteriorly of the upright support member and releasably attached to and stretchably extends between the lower and upper support members and is disposed on the opposite side of the pivot axis from the ball suspension rod such that when the ball-shaped object on the outer end of the ball suspension rod is hit by the player's bat the elastic member stretches and allows the upper support member and ball suspension rod to rotate about the axis until the energy of the rotational motion is absorbed by the stretched elastic member and the tension of the elastic member causes the upper support member and ball suspension rod to rotate in reverse about the axis.

26 Claims, 7 Drawing Sheets

SELF-TRAINING BATTING PRACTICE MACHINE

BACKGROUND OF THE INVENTION

1. Field of the Invention

The present invention generally relates to devices used to practice sports activities, such as hitting a ball, and, more particularly, is concerned with a self-training batting practice machine.

2. Description of the Prior Art

Baseball and softball are sports activities which require a considerable amount of practice. Batting or hitting is an integral part of baseball and softball and involves a great amount of skill and coordination. Consequently, players commonly participate in batting practice. Batting practice generally requires at least a pitcher in addition to the batter. The pitcher is needed to throw the ball for the batter to hit. However, a pitcher may not always be available. Various devices have been developed over the years which allow players to practice batting without a pitcher.

Representative examples of such devices made for players to practice batting and the like are disclosed in U.S. Pat. No. 1,862,044 to White, U.S. Pat. No. 1,962,087 to Cone, U.S. Pat. No. 2,818,255 to Ponza and U.S. Pat. No. 5,553,848 to Amron. While these prior art devices may be satisfactory in use for the specific purposes for which they were designed, none of them seem to provide an optimum solution for the problem at hand of how to effectively practice batting without the aid of a pitcher.

Consequently, a need still exists for an innovation which will provide a more effective solution to the aforementioned problem without introducing any new problems in place thereof.

SUMMARY OF THE INVENTION

The present invention provides a self-training batting practice machine designed to satisfy the aforementioned need. The batting practice machine of the present invention provides an optimum solution for players to practice batting alone and thus to self-train by employing a flexible ball suspension rod having a ball-like object on an outer end thereof and which flexible rod is horizontally swingable when hit so as to allow the batter to better "read" or determine the quality of his or her swing and contact just by observing the path taken by the batted ball-like object on the end of the flexible suspension rod. The batting practice machine enables a batter to practice more hitting in a shorter period of time by employing one or more power bands which are adjustable to control the velocity of forward and return motion of the ball-like object such that the one cycle takes only from three to five seconds. The batting practice machine works equally well for left-hand hitters as for right-hand hitters and is simple but durable in its construction and easy to setup and use.

Accordingly, the present invention is directed to a self-training batting practice machine which comprises: (a) an upright support member having an upper end and a lower end mountable to a surface; (b) a lower support member having an end attached to the upright support member at a location closer to the lower end than to the upper end of the upright support member and extending substantially horizontally outwardly from the upright support member; (c) an upper support member supported on the upper end of the upright support member such that the upper support member is rotatable relative to the upright support member about a generally vertical pivot axis defined by the upright support member; (d) a flexible ball suspension rod having an inner end and an outer end and being connected at the inner end thereof to and rotatable with the upper support member and extending substantially horizontally outwardly from the upper support member, the outer end of the flexible ball suspension rod having a substantially ball-shaped object thereon for a player to swing a bat at and to hit in order to practice batting; and (e) at least one elastic member disposed exteriorly of the upright support member and releasably attached to and stretchably extending between the lower support member and the upper support member and being disposed on the opposite side of the pivot axis from the ball suspension rod such that when the ball-shaped object on the outer end of the ball suspension rod is hit by the bat swung by the player the elastic member stretches and allows the upper support member and the ball suspension rod to rotate about the axis away from the player until the energy of the rotational motion is absorbed by the stretched elastic member and the tension of the elastic member causes the upper support member and the ball suspension rod to rotate in reverse about the axis back toward the player.

More particularly, the lower end of the upright support member may be inserted into the surface for securing the machine to the surface. The upright support member includes a lower tube having an interior cavity and an upper support rod having an upper end and a lower end. The upper support rod is slidably inserted through an open upper end of the lower tube such that the lower end of the support rod is disposed within the interior cavity of the lower tube and the upper end of the support rod extends above the lower tube and mounts the upper support member. The upright support member has a height adjustment device mounted to the lower tube adjacent to the open upper end thereof and being rotatable in opposite directions and thereby movable toward and away from the lower end of the upper support member between engaged and disengaged positions therewith. In the disengaged position the height adjustment device is loosened relative to the support rod so that the support rod is free to be slidably moved vertically within and with respect to the interior cavity of the lower tube for adjusting the height of the upper support member above the surface. In the engaged position the height adjustment device is tightened relative to the support rod so that the support rod is held stationary in place with respect to the lower tube.

The lower support member includes an inner bar, an outer sleeve having an end and defining an interior cavity open at the end such that outer sleeve is received over the inner bar with the inner bar extending through the open end and within the interior cavity thereof, and a length adjustment device mounted to the outer sleeve and being rotatable in opposite directions and thereby movable toward and away from the inner bar between engaged and disengaged positions therewith. In the disengaged position the length adjustment device is loosened relative to the inner bar so that the outer sleeve is free to be slidably moved horizontally over the inner bar so as to increase or decrease the overall length of the lower support member and thereby the amount of resistance of the elastic member to the rotation of the upper support member and ball suspension rod about the axis as determined by the corresponding increase or decrease of distance at which the elastic member is connected to the lower support member away from the upright support member. In the engaged position the length adjustment device is tightened relative to the inner bar such that the outer sleeve is held stationary in place with respect to the inner bar so that a desired overall length of the lower support member is thereby maintained. Further, the lower support member has at least one and may have a plurality of hooks for attaching one or more of the elastic members to the lower support member. The upper support member has a hook for attaching the one or more elastic members to the upper support member. Each hook of the lower support member is for attaching one of the elastic members to the lower support member.

The upper support member has an upper horizontal head and a lower vertical neck such that the upper support member has a substantially T-shaped configuration. The lower vertical neck of the upper support member is tubular and has a lower end and defines an interior passage open at the lower end thereof. The support rod is slidably inserted through the open lower end of the lower vertical neck of the upper support member such that the upper end of the support rod is disposed within the interior passage of the lower vertical neck of the upper support member and abuts the upper horizontal head.

The upper horizontal head of the upper support member is tubular and has an end and defines an interior chamber open at the end. The inner end of the flexible ball suspension rod is slidable inserted through the open end and disposed within the interior chamber of the upper horizontal head of the upper support member. The upper support member has a releasable securing means in the form of a pair of fasteners mounted to the upper horizontal head of the upper support member at spaced locations thereon. Each fastener is rotatable in opposite directions and thereby movable toward and away from the inner end of the ball suspension rod between disengaged and engaged positions relative thereto. Each fastener in the disengaged position is loosened from the inner end of the ball suspension rod such that the ball suspension rod is free to be slidably moved horizontally within the interior chamber of the upper horizontal head of the upper support member to insert and remove the ball suspension rod. Each fastener in the engaged position is tightened against the inner end of the ball suspension rod such that the inner end of the ball suspension rod is held stationarily in place within the interior chamber of the upper horizontal head of the upper support member.

The machine also can include a base having a plurality of leg members which cross one another at a central location for resting on the surface. The lower end of the upright support member is mounted to the base at the central location thereon.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
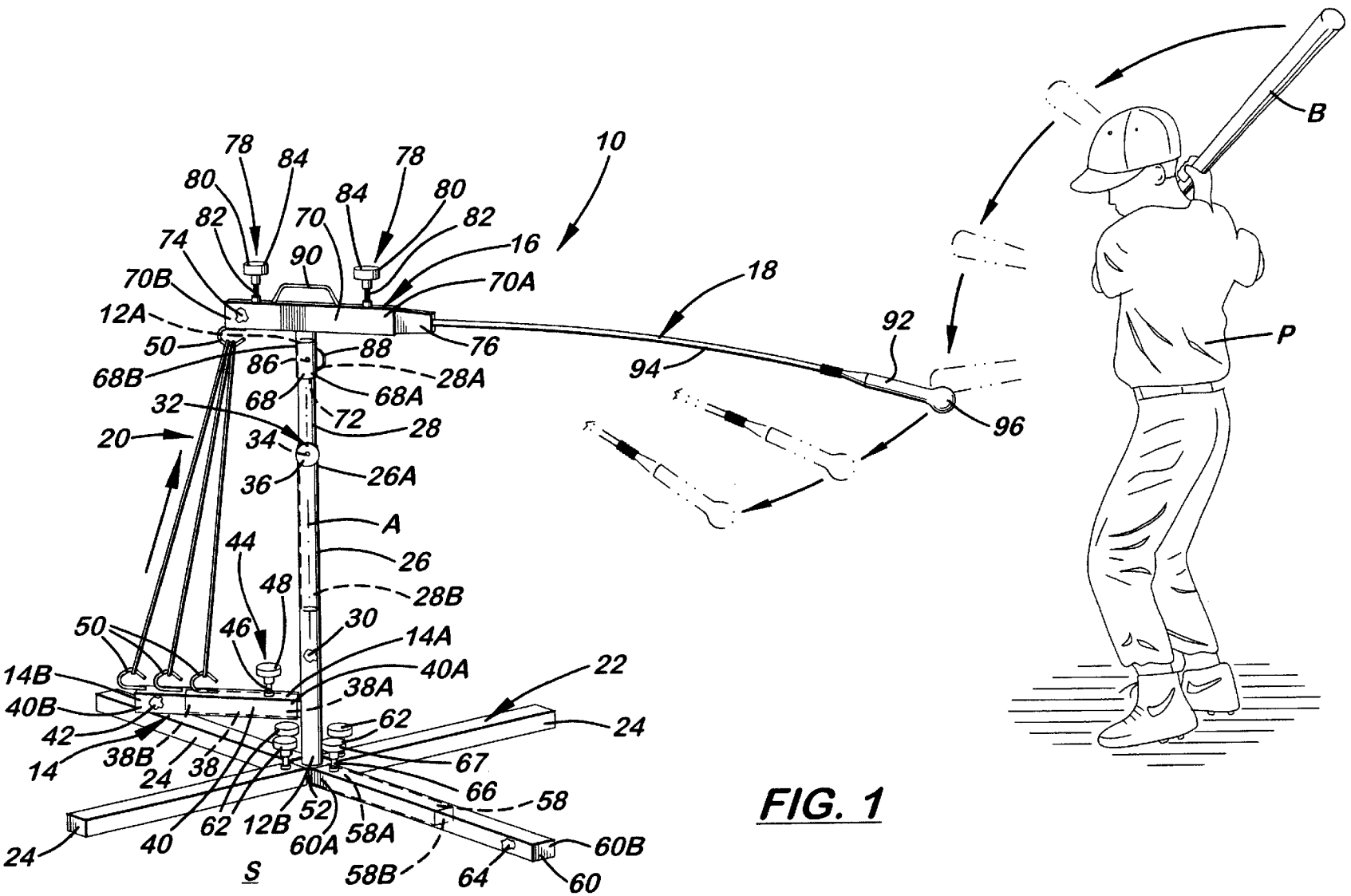
FIG. 1 is a perspective view of a first embodiment of a self-training batting practice machine of the present invention.
Figure 2:
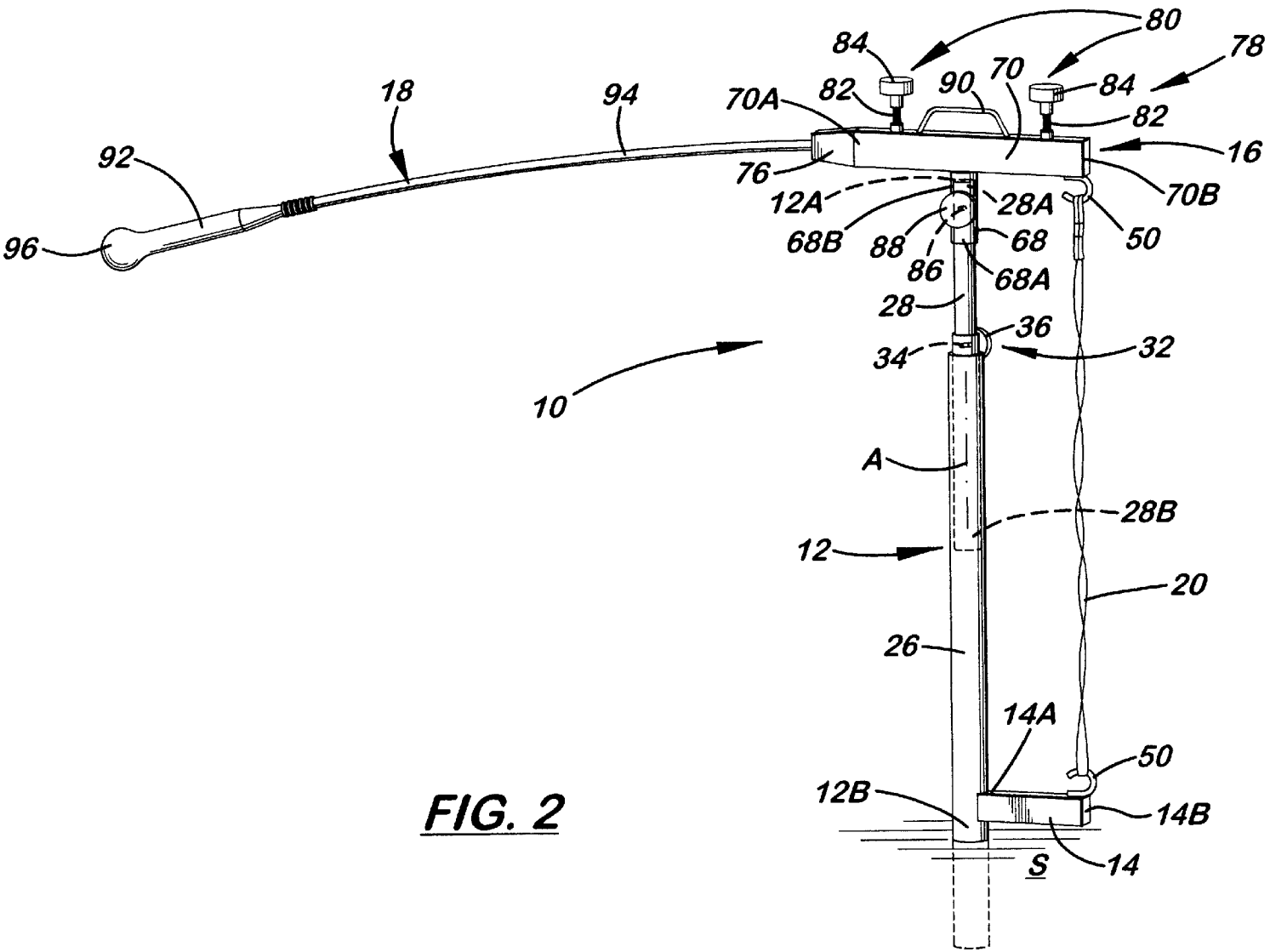
FIG. 2 is a perspective view of a second embodiment of the batting practice machine.
Figure 3:
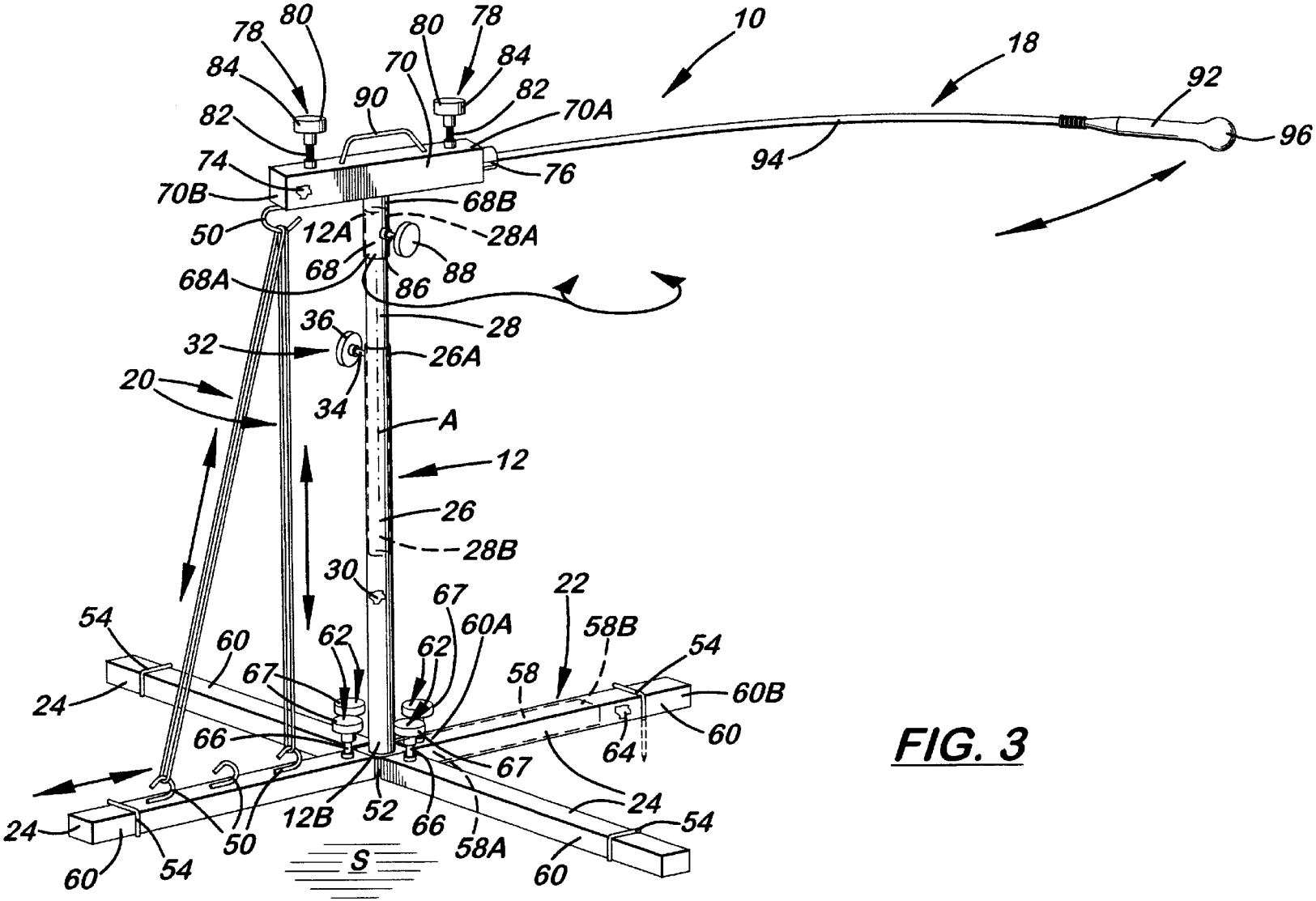
FIG. 3 is a perspective view of a third embodiment of the batting practice machine.

Referring to the drawings and particularly to FIGS. 1 to 3, there is illustrated a self-training batting practice machine, generally designated 10, of the present invention. A first embodiment of the machine 10 is shown in FIG. 1, a second embodiment in FIG. 2, and a third embodiment in FIG. 3. In each of the first and second embodiments, the machine 10 basically includes an upright support member 12, a lower support member 14, an upper support member 16, a flexible ball suspension rod 18 and at least one elastic member or cord 20. The first embodiment of FIG. 1, the machine 10 also includes a base 22 formed by a plurality of legs 24. In the second embodiment of FIG. 2, the upright support member 12 is inserted directly into a surface S for securing the machine 10 to the surface S. In the third embodiment of FIG. 3, the lower support member 14 is formed as one of the legs 24 of the base 22.

Referring now to FIGS. 1 to 4, 6, 8 and 12 to 16, the upright support member 12 of the machine 10 has a generally cylindrical configuration, defines a longitudinal vertical axis A, and has an upper end 12A and a lower end 12B mountable to the surface S such that the upright support member 12 is stationarily and nonrotatably mounted upon the surface S via the base 22, as in the first and third embodiments of FIGS. 1 and 3, or stationarily and nonrotatably mounted to the surface S, as in the second embodiment of FIG. 2. More particularly, the upright support member 12 includes a lower tube 26 and an upper support rod 28. The lower tube 26 has an open upper end 26A and forms an interior cavity 30. The upper support rod 28 has an upper end 28A and a lower end 28B and is slidably inserted downward through the open upper end 26A of the lower tube 26 such that the lower end 28B of the upper support rod 28 is disposed within the interior cavity 30 of the lower tube 26 in a close fitting telescopic relationship therewith and the upper end 28A of the upper support rod 28 extends above the lower tube 26 for supporting the upper support member 16.

The upright support member 12 also has a height adjustment device 32 mounted to the lower tube 26 adjacent to the open upper end 26A thereof for adjusting the position of the upper support rod 28 within the lower tube 26 and thereby the height at which the upper support member 16 is supported above the surface S by the upright support member 12. The height adjustment device 32 preferably is in the form of a screw stem 34 threadably mounted to the lower tube 26 and a knob 36 on the screw stem 34 for gripping to rotate the screw stem 34 of the height adjustment device 32 in opposite directions relative to the lower tube 26 and upper support rod 28 and thereby move the screw stem 34 toward and away from the lower end 28B of the upper support rod 28 between engaged and disengaged positions therewith. In the disengaged position, the screw stem 34 of the height adjustment device 32 is loosened relative to the upper support rod 28 so that the support rod 28 is free to be slidably moved vertically within and relative to the lower tube 26 for adjusting the height of the upper support member 16 above the surface S. In the engaged position, the screw stem 34 of the height adjustment device 32 is tightened against the lower end 28B of the upper support rod 28 so that the support rod 28 is held stationary in place with respect to the lower tube 26 and the upper support member 16 is disposed at a desired height above the surface S.

In the first and second embodiments of FIGS. 1 and 2, the lower support member 14 of the machine 10 is spaced above the base 22 and has a substantially rectangular configuration and a pair of opposite inner and outer ends 14A, 14B. The lower support member 14 is fixedly attached at its inner end 14A to the lower tube 26 of the upright support member 12 at a location therealong adjacent to the lower end 12B and remote from the upper end 12A of the upright support member 12. The lower support member 14 extends substantially horizontally and radially outwardly from adjacent to the lower end 12B of the upright support member 12. More particularly, in the first embodiment of FIG. 1, the lower support member 14 includes an inner bar 38 and an outer sleeve 40 having respective complementary rectangular configurations. The inner bar 38 has opposite ends 38A, 38B. The inner bar 38 is fixed at its one end 38A to the lower tube 26 of the upright support member 12. The outer sleeve 40 has opposite ends 40A, 40B. The outer sleeve 40 is tubular and defines an interior cavity 42 open at the one end 40A thereof. The outer sleeve 40 is slidably received over the inner bar 38 in a close fitting telescopic relationship such that the inner bar 38 extends through the open end 40A and within the interior cavity 42 of the outer sleeve 40. The rectangular configurations of the inner bar 38 and outer sleeve 40 prevents relative rotation therebetween.

The lower support member 14 also includes a length adjustment device 44 mounted to the outer sleeve 40 for adjusting the position of the outer sleeve 40 along the inner bar 38 and thereby for adjusting the overall length of the lower support member 14 and the amount of tension in the elastic member or cord 20. The length adjustment device 44 preferably is in the form of a screw stem 46 threadably mounted to the outer sleeve 40 and a knob 48 on the screw stem 46 for gripping to rotate the screw stem 46 in opposite directions and thereby move the screw stem 46 toward and away from the inner bar 38 between engaged and disengaged positions therewith. In the disengaged position, the screw stem 46 of the length adjustment device 44 is loosened relative to the inner bar 38 so that the outer sleeve 40 is free to be slidably moved horizontally over the inner bar 38 so as to increase or decrease the overall length of the lower support member 14 and thereby increase or decrease the amount of resistance of the elastic member 20 to the rotation of the upper support member 16 and ball suspension rod 18 about the axis A as determined by the corresponding increase or decrease of distance at which the elastic member 20 is connected to the lower support member 14 away from the upright support member 12. In the engaged position, the screw stem 46 of the length adjustment device 44 is tightened relative to the inner bar 38 such that the outer sleeve 40 is held stationary in place with respect to the inner bar 38 so that a desired overall length of the lower support member 14 and amount of resistance of the elastic member 20 are thereby maintained. The speed of rotation of the upper support member 16 and ball suspension rod 18 about the axis A is determined by the amount of resistance the elastic cord 20 exerts on the upper support member 16. The amount of resistance and thus the speed of rotation may be increased or decreased by connection of the elastic cord 20 to the lower support member 14 correspondingly farther away from or closer to the upright support member 12. The lower support member 14 is a single member in the second embodiment of the machine 10, as shown in FIG. 2.

The lower support member 14 has at least one hook element 50 thereon. The hook element 50 is for attaching the elastic cord 20 to the lower support member 14. The lower support member 14 has a plurality of hook elements 50 in the first embodiment of the machine 10, as shown in FIG. 1, and has a single hook element 50 in the second embodiment of the machine 10, as shown in FIG. 2. The hook elements 50 in the first embodiment of the machine 10 may number three, though they need not be so limited. The hook elements 50 in the first embodiment of the machine 10 are spaced apart from one another on the outer sleeve 40 beginning at the other end 40B of the outer sleeve 40 to a point spaced from the one end 40A thereof. Each hook element 50 in the first embodiment of the machine 10 is for attaching one elastic cord 20 to the lower support member 14. The hook element 50 in the second embodiment of the machine 10 is disposed at the other end 14B of the lower support member 14 and is for attaching one elastic cord 20 to the lower support member 14. The lower support member 14 thus has at least one hook element 50 for attaching the elastic member 20 to the lower support member 14 and the upper support member 16 has a single hook element 50 for attaching the elastic member 20 to the upper support member 16.

Figure 4:
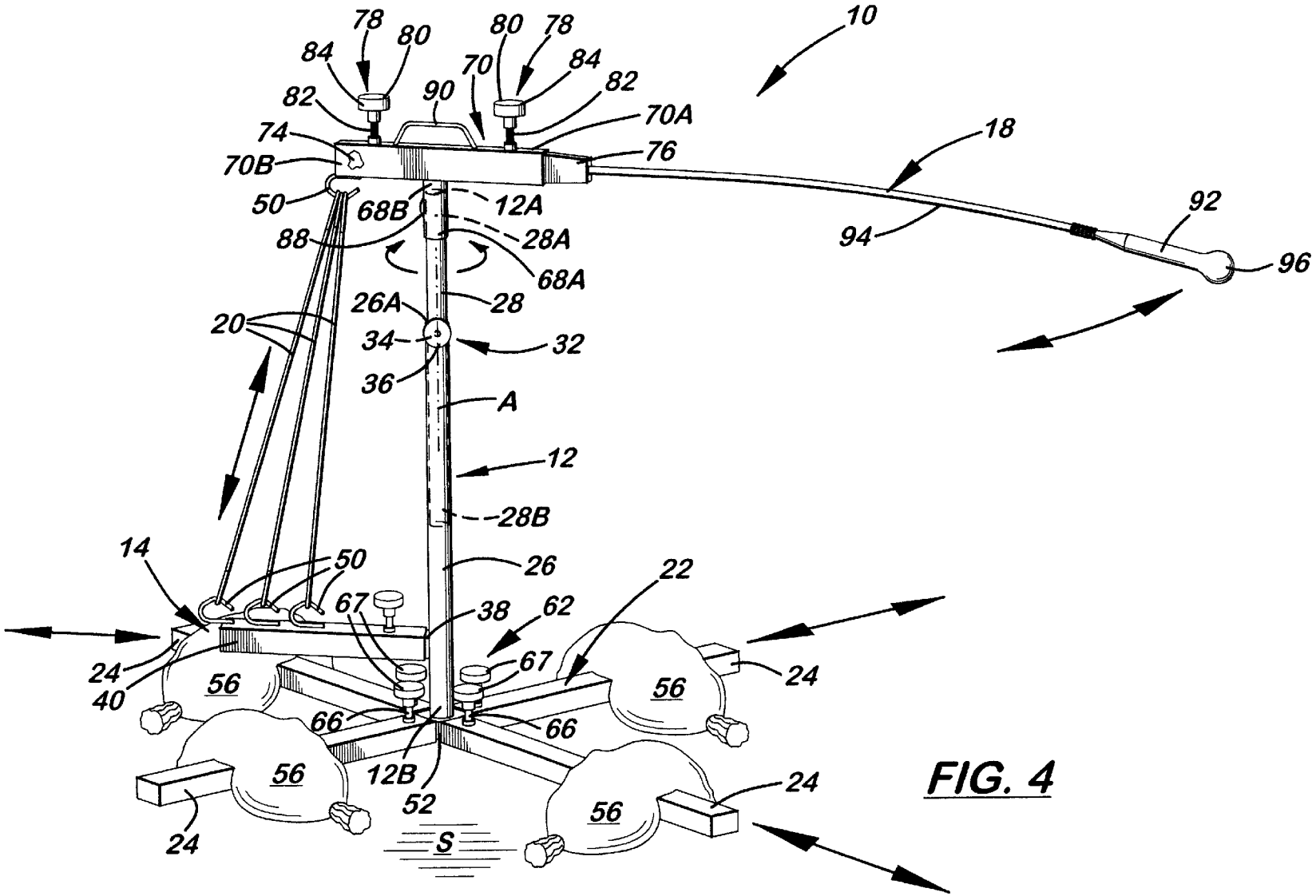
FIG. 4 is another perspective view of the machine of FIG.

The base 22 of the machine 10 in the first and third embodiments of FIGS. 1 and 3–4 has a plurality of the leg members 24 which cross one another at a central location 52. The leg members 24 preferably number four, though they may be of any other suitable number. The leg members 24 are adapted for resting on the surface S. The lower end 12A of the upright support member 12 is fixedly mounted to the base 22 at the central location 52. The leg members 24 of the base 22 are secured to the surface S by any suitable means, such as by stakes 54, as shown in FIG. 3, or by sacks 56 filled with any suitable weighted material, as shown in FIG. 4. More particularly, each of the leg members 24 has an inner bar 58, an outer sleeve 60 and a length adjustment device 62. The inner bar 58 has opposite ends 58A, 58B. Each of the inner bar 58 and the outer sleeve 60 has a substantially rectangular configuration. The inner bar 58 is fixed at the one end 58A to the lower tube 26 of the upright support member 12. The outer sleeve 60 has opposite ends 60A, 60B. The outer sleeve 60 is tubular and defines an interior cavity 64 open at the one end 60A. The outer sleeve 60 is received over the inner bar 58 through the open end 60A and within the interior cavity 64 of the outer sleeve 60. The length adjustment device 62 is in the form of a screw stem 66 threadably mounted to the outer sleeve 60 and a knob 67 fixed on the screw stem 66 for gripping to rotate the screw stem 66. The screw stem 66 is disposed closer to the one end 60A than to the other end 60B of the outer sleeve 60. The screw member 66 is rotatable in opposite directions and thereby movable toward and away from the inner bar 58 between a disengaged position and an engaged position relative to the inner bar 58. In the disengaged position, the screw stem 66 is loosened relative to the inner bar 58 such that the outer sleeve 60 is free to be slidably moved horizontally over the inner bar 58 such that the overall length of the leg member 24 can thereby be increased and decreased. In the engaged position, the screw stem 66 is tightened against to the inner bar 58 such that the outer sleeve 60 is held stationary in place with respect to the inner bar 58 and a desired effective length of the leg member 24 is thereby maintained. As mentioned previously, in the third embodiment of FIG. 3 the lower support member 14 is formed as one of the legs 24 of the base 22.

The base 22 also has at least one and, preferably, a plurality of hook elements 50 in the third embodiment of the machine 10 of FIG. 3. The hooks 50 may number three, though they need not be so limited. The base 22 does not have any hooks in the first embodiment of the machine 10 of FIG. 1. The hooks 50 are provided for attaching one or more elastic cords 20 to the base 22. The hooks 50 are spaced apart from one another on the outer sleeve member 60 of one of the leg members 24 of the base 22. The hooks 50 of the base 22 have substantially the same function and operate in the same way as the hooks 50 of the lower support member 14.

The upper support member 16 of the machine 10 is supported on the upper end 12A of the upright support member 12 and, more particularly, on the upper end 28A of the upper support rod 28 thereof, such that the upper support member 16 is rotatable relative to the upright support member 12 and about the vertical pivot axis A defined by the upright support member 12. The upper support member 16 has a lower vertical neck 68 and an upper horizontal head 70 such that the upper support member 16 has a substantially T-shaped configuration, as shown in FIGS. 1 to 4 and 9 to 16. The lower vertical neck 68 has a lower end 68A and an upper end 68B. The lower vertical neck 68 has a substantially cylindrical configuration and is tubular so as to defines an interior passage 72 open at the lower end 68A such that the lower vertical neck 68 is rotatably received over the upper end 28A of upper support rod 28 of the upright support member 12. The upper end 28A of the upper support rod 28 of the upright support member 12 extends into the interior passage 72 of the lower vertical neck 68 of the upper support member 68 and abuts the upper horizontal head 70 of the upper support member 16.

The upper horizontal head 70 of the upper support member 16 has opposite ends 70A, 70B and a substantially rectangular configuration. The upper horizontal head 70 also is tubular such that it defines an interior chamber 74 open at each of its opposite ends 70A, 70B. An inner end 76 of the ball suspension rod 18 of the machine 10 is disposed through one of the open ends 70A and within the interior chamber 74 of the upper horizontal head 70 of the upper support member 16. The upper support member 16 also has releasable securing means 78 in the form of a pair of fasteners 80, comprised of a screw stem 82 and knob 84, mounted to the upper horizontal head 70 of the upper support member 16 at spaced locations thereon and being rotatable in opposite directions and thereby movable. toward and away from the inner end 76 of the ball suspension rod 18 between disengaged and engaged positions relative thereto. In the disengaged position, each fastener 80 is loosened from the inner end 76 of the ball suspension rod 18 so that the ball suspension rod 18 is free to be slidably moved horizontally within the interior chamber 74 of the upper horizontal head 70 to insert and remove the ball suspension rod 18 into and from the interior chamber 74. In engaged position, each fastener 80 is tightened against the inner end 76 of the ball suspension rod 18 so that the inner end 76 of the ball suspension rod 18 is held stationarily in place within the interior chamber 74 of the upper horizontal head 70 of the upper support member 16.

During periods of non-use, the upper support member 16 can be attached to the upper end 28A of the upper support rod 28 of the upright support member 12 by means of a screw stem 86 threadably attached to the lower vertical neck 68 and a knob 88 fixed on the screw stem 86 for gripping to rotate the screw stem 86 in opposite directions relative to the lower vertical neck 68 between a disengaged position and an engaged position relative to the upper end 28A of the support rod 28. In the disengaged position, the screw stem 86 is loosened relative to the support rod 28 such that the upper support member 16 is free to rotate on the support rod 28. In the engaged position, the screw stem 86 is tightened relative to the support rod 28 such that the upper support member 16 is held stationary in place with respect to the support rod 28. The upper support member 16 also has a handle 90 attached to the upper horizontal head 70 and having a substantially inverted U-shaped configuration. The handle 90 is spaced from and disposed between the fasteners 80 on the upper horizontal head 70. During periods of non-use of the machine 10, the handle 90 is for a user to grip in lifting the machine 10 and in adjusting the height of the upper support member 16 from the surface S.

The upper support member 16 also has a hook element 50 mounted to the upper horizontal head 70. The hook element 50 is disposed at the other end 70B of the upper horizontal head 70. The hook 50 is for attaching one or more elastic cords 20 to the upper support member 16.

The flexible ball suspension rod 18 of the machine 10 has the inner end 76, an outer end 92 and a middle portion 94 extending between and interconnecting the inner and outer ends 76, 92. The ball suspension rod 18 at its inner end 76 is secured to and rotatable with the upper support member 16 and at its middle portion 94 and outer end 92 extend substantially horizontally outwardly from the upper support member 16. The outer end 92 of the ball suspension rod 18 has a substantially ball-shaped object 96 thereon for a player P to swing a bat B at and to hit in order to practice batting. The inner end 76 has a substantially rectangular configuration which conforms to and fits with the interior cavity 74 of the upper horizontal head 70 of the upper support member 16. The middle portion 94 has a substantially rod-like configuration and interconnects outer end 92 to the inner end 76 such that the ball suspension rod 18 extends in a cantilevered fashion from the upper horizontal head 70 of the upper support member 16.

Figure 12:
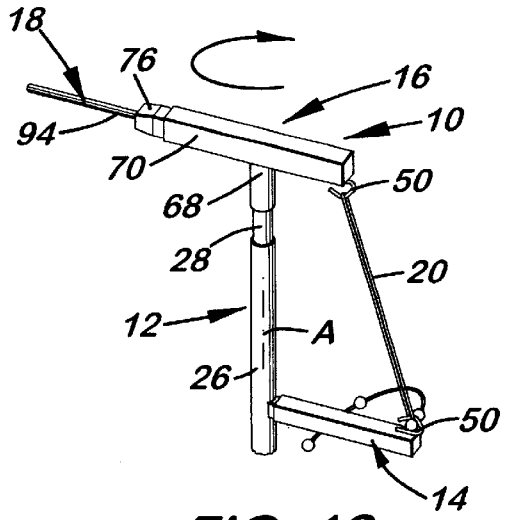
FIG. 12 is a fragmentary perspective view of the machine shown on a reduced scale and before an outer end of the flexible ball suspension rod of the machine is hit by a bat.
Figure 13:
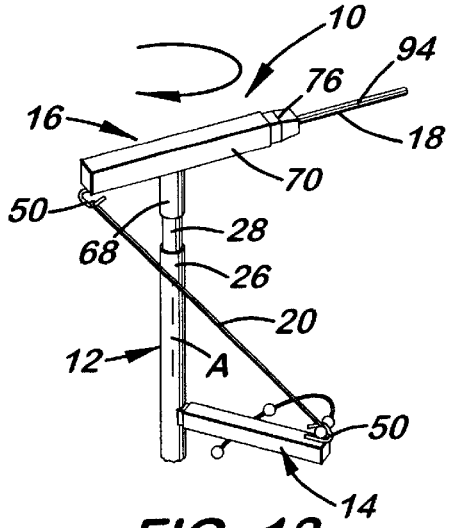
FIGS. 13 to 16 are views of the machine similar to that of FIG. 12 but showing in sequence the rotation of the upper support member and flexible ball suspension rod therewith relative to the upright support member and the stretching and wrapping of the elastic cord about the upright support member as a result of the outer end of the flexible ball suspension rod of the machine being hit by-the bat.
Figure 14:
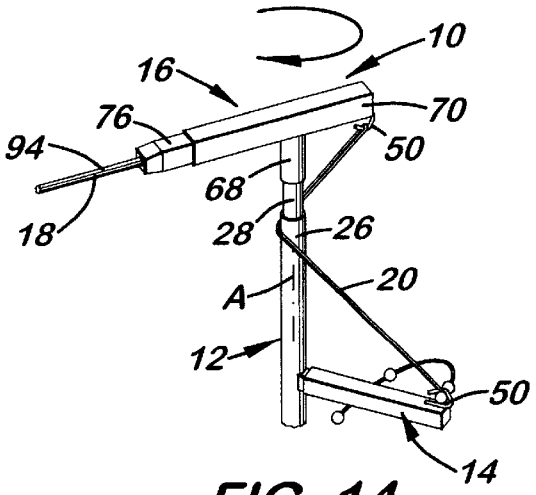
Figure 15:
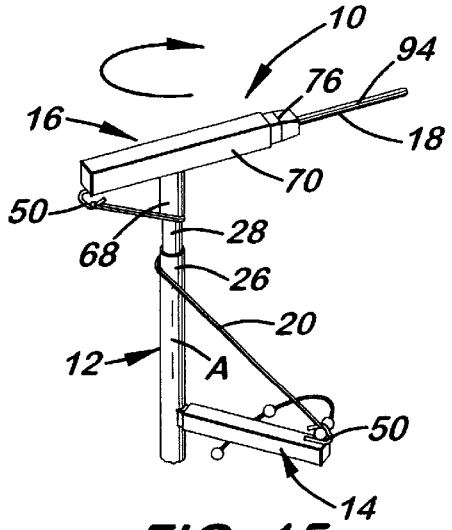
Figure 16:
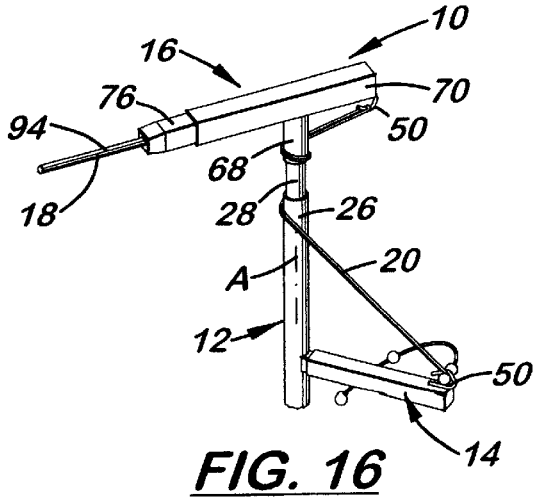

The machine 10 includes at least one elastic cord 20, as seen in the second embodiment of FIGS. 2, 6, 8 and 12–16, and preferably a plurality of elastic cords 20, as seen in the first embodiment of FIGS. 1 and 4 and the third embodiment of FIG. 3. Each elastic cord 20 of the machine 10 is disposed exteriorly of the upright support member 12 and releasably attached to and stretchably extends between the lower support member 14 in the first and second embodiments and the upper support member 16 or between one of the legs 24 in the third embodiment and the upper support member 16. Furthermore, each elastic cord 20 extends along the upright support member 12 generally between the ends thereof and is disposed on the opposite side of the pivot axis A from the outer end 92 of the ball suspension rod 18 such that when the ball-shaped object 96 on the outer end 92 of the ball suspension rod 18 is hit by the bat B swung by the player P, the elastic cord 20 stretches and is at least partially wrapped about the upright support member 12 so as to allow[s] the upper support member 16 and ball suspension rod 18 to rotate about the vertical pivot axis A away from the player P until the energy of the rotational motion is absorbed by the stretched elastic cord 20 and the tension of the elastic cord 20 causes the elastic cord 20 to unwrap from about the upright support member 12 so as to cause the upper support member 16 and ball suspension rod 18 to cease rotation and then rotate in reverse about the axis A back toward the player P. A sequence of the pivoting of the upper support member 16 and the ball suspension rod 18 and the stretching of the elastic cord 20 after the object 98 on the outer end 94 of the ball suspension rod 18 is hit by the bat B is shown in FIGS. 12 to 16. More particularly, FIG. 12 shows the machine 10 before the outer end (not shown) of the ball suspension rod 18 is hit by the bat. FIGS. 13–16 show in sequence the rotation of the upper support member 16 and flexible ball suspension rod 18 therewith relative to the upright support member 12 and the stretching and wrapping of the elastic cord 20 about the upright support member 12 as a result of the outer end (not shown) of the flexible ball suspension rod 18 of the machine 10 being hit by the bat.

Figure 5:
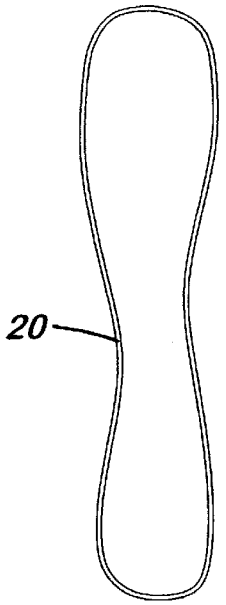
FIG. 5 is a side elevational view of a first embodiment of an elastic cord employed by the machine.
Figure 6:
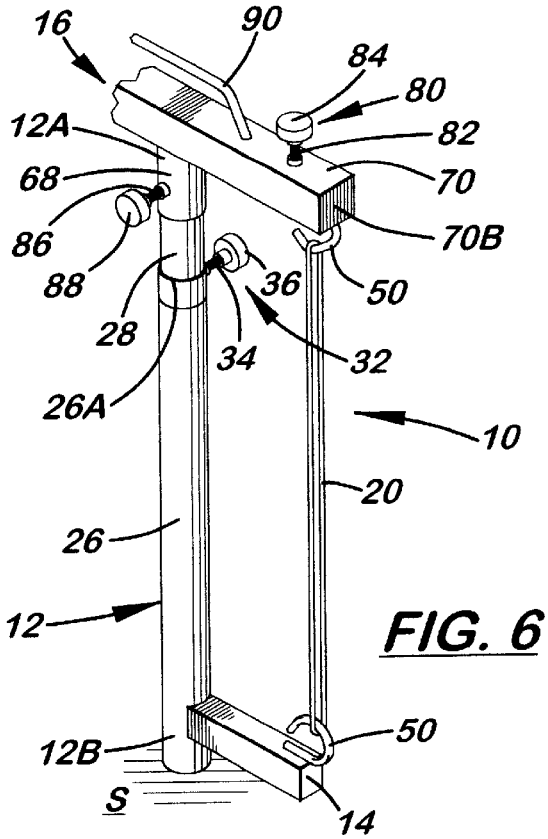
FIG. 6 is a fragmentary perspective view of the machine of FIG. 2 showing the elastic cord of FIG. 5 mounted to and extending between lower and upper support members of the machine.
Figure 7:
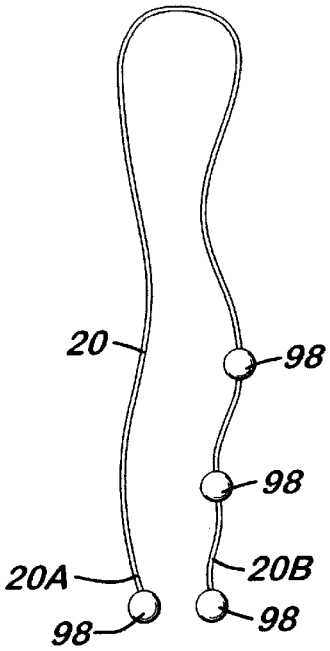
FIG. 7 is a side elevational view of a second embodiment of an elastic cord employed by the machine.
Figure 8:
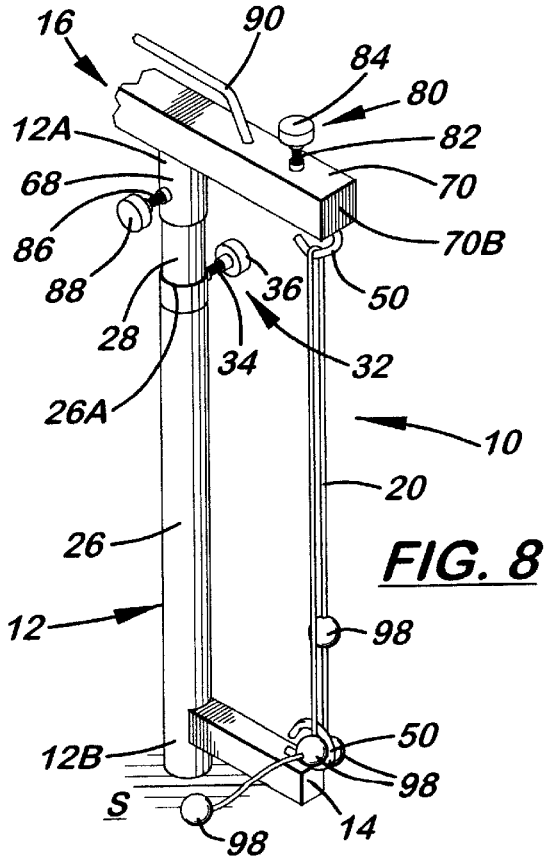
FIG. 8 is a fragmentary perspective view of the machine of FIG. 2 showing the elastic cord of FIG. 7 mounted to and extending between lower and upper support members of the machine.
Figure 9:
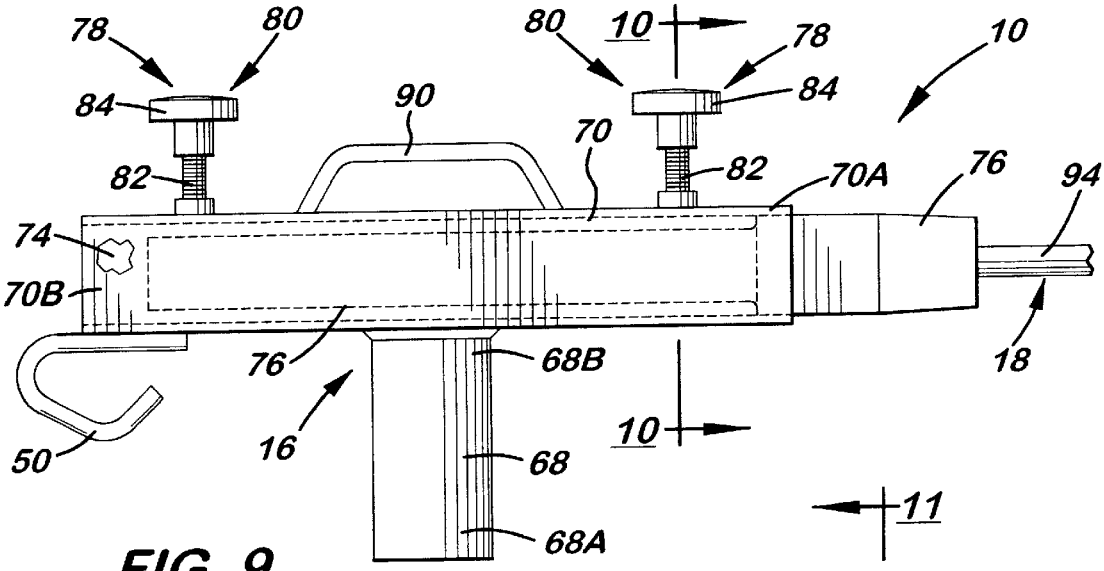
FIG. 9 is an enlarged detailed side elevational view of the upper support member and a portion of a flexible ball suspension rod of the machine.
Figure 10:
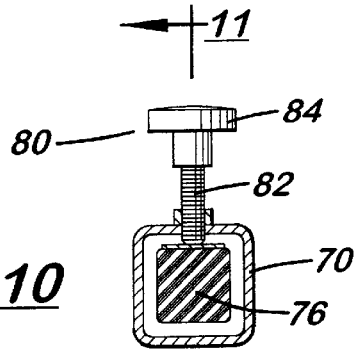
FIG. 10 is a transverse sectional view of the upper support member of the machine taken along line 10—10 of FIG. 9.
Figure 11:
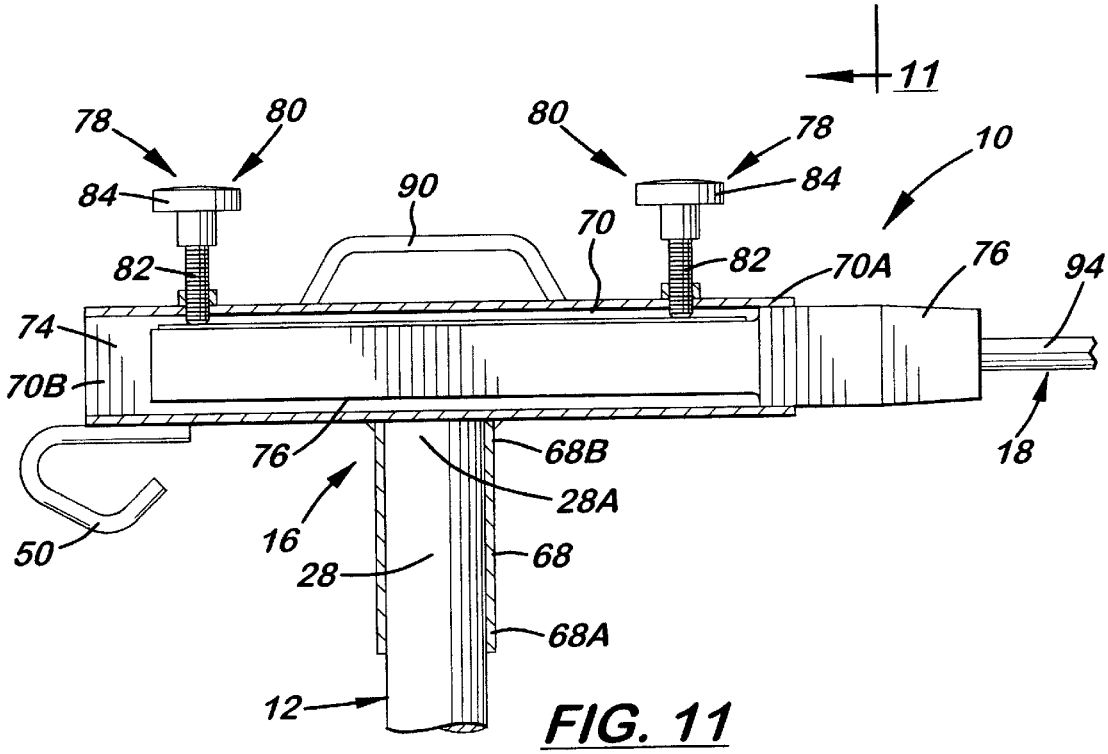
FIG. 11 is a longitudinal sectional view of the upper support member of the machine taken along line 11—11 of FIG. 10.

The at least one elastic cord 20 may be a plurality of elastic cords 20, as shown in FIGS. 1, 3 and 4. The number of elastic cords 20 may be the same as the number of hooks 50 of the lower support member 14 or any other suitable number of elastic cords 20. The elastic cord 20 may have one of two embodiments. A first embodiment of the elastic cord 20 is a closed loop, as shown in FIGS. 5 and 6. The elastic cord 20 having the first embodiment can be hooked about the hooks 50 of the lower support member 14 and the upper support member 16. A second embodiment of the elastic cord 20 is linear and has opposite ends 20A, 20B, as shown in FIGS. 7 and 8. The elastic cord 20 having the second embodiment has a ball 98 mounted thereto at the end 20A and a plurality of the balls 98 mounted thereto at and adjacent to the end 20B. The balls 98 at and adjacent to the end 20B are spaced apart from one another. The elastic cord 20 having the second embodiment can be hooked about the hooks 50 of the lower support member 14 and the upper support member 16 and such that the balls 98 abut against the one or more hooks 50 of the lower support member 14 and retain the elastic cord 20 in place at the one or more hooks 50 of the lower support member 14.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A self-training batting practice machine, comprising:

(a) an upright support member having an upper end and a lower end mountable to a surface so as to mount said upright support member in a stationary and non-rotatable relationship to the surface;

(b) a lower support member having an end attached to said upright support member at a location adjacent to said lower end of said upright support member and closer to said lower end than to said upper end of said upright support member, said lower support member extending substantially horizontally outwardly from said upright support member;

(c) an upper support member supported on said upper end of said upright support member such that said upper support member is rotatable relative to said upright support member and said lower support member about a pivot axis defined by said upright support member;

(d) a flexible ball suspension rod having an inner end and an outer end and being secured at said inner end thereof to and being rotatable with said upper support member and extending substantially horizontally outwardly from said upper support member, said outer end of said ball suspension rod having a substantially ball-shaped object thereon for a player to swing a bat at and to hit in order to practice batting; and (e) at least one elastic member disposed exteriorly of said upright support member and releasably attached to and stretchably extending between said lower support member and said upper support member and extending along said upright support member generally between said upper and lower ends thereof and being disposed on the opposite side of said pivot axis from said ball suspension rod such that when said ball-shaped object on said outer end of said ball suspension rod is hit by the bat swung by the player said elastic member stretches and is at least partially wrappable about said upright support member so as to allow said upper support member and said ball suspension rod to rotate about said axis until the energy of the rotational motion is absorbed by said stretched and wrapped elastic member and the tension of said elastic member causes the rotation of said upper support member and said ball suspension rod to cease and said elastic member to unwrap from about said upright support member so as to cause said upper support member and said ball suspension rod to rotate in reverse about said axis.

2. The machine of claim 1 wherein said lower end of said upright support member is inserted into the surface for securing said machine to the surface.

3. The machine of claim 1 wherein said upright support member includes:

a lower tube having an open upper end and an interior cavity; and an upper support rod having an upper end and a lower end and being slidably inserted through said open upper end of said lower tube such that said lower end of said support rod is disposed within said interior cavity of said lower tube and said upper end of said upper support rod extends above said lower tube and mounts said upper support member.

4. The machine of claim 3 wherein said upright support member has a height adjustment device mounted to said lower tube adjacent to said open upper end thereof and being rotatable in opposite directions and thereby movable toward and away from said lower end of said upper support between engaged and disengaged positions therewith such that in said disengaged position said height adjustment device is loosened relative to said support rod so that said support rod is free to be slidably moved vertically within and with respect to said interior cavity of said lower tube for adjusting the height of said upper support member above the surface and in said engaged position said height adjustment device is tightened relative to said support rod so that said support rod is held stationary in place with respect to said lower tube.

5. The machine of claim 1 wherein said lower support member includes:

an inner bar;

an outer sleeve having an end and defining an interior cavity open at said end, said outer sleeve received over said inner bar such that said inner bar extends through said open end and within said interior cavity thereof; and a length adjustment device mounted to said outer sleeve and being rotatable in opposite directions and thereby movable toward and away from said inner bar between engaged and disengaged positions therewith such that in said disengaged position said length adjustment device is loosened relative to said inner bar so that said outer sleeve is free to be slidably moved horizontally over said inner bar so as to increase or decrease the overall length of said lower support member and thereby the amount of resistance of said elastic member to the rotation of said upper support member and ball suspension rod about said axis as determined by the corresponding increase or decrease of distance at which said elastic member is connected to said lower support member away from said upright support member and in said engaged position said length adjustment device is tightened relative to said inner bar such that said outer sleeve is held stationary in place with respect to said inner bar so that a desired overall length of said lower support member is thereby maintained.

6. The machine of claim 1 wherein:

said lower support member has at least one hook element for attaching said elastic member to said lower support member; and said upper support member has a hook element for attaching said elastic member to said upper support member.

7. The machine of claim 1 wherein said at least one elastic member is an elastic cord.

8. The machine of claim 1 wherein:

said at least one elastic member is a plurality of elastic cords;

said lower support member has a plurality of hooks each for attaching one of said elastic cords to said lower support member; and said upper support member has a hook for attaching each of said elastic cords to said upper support member.

9. The machine of claim 1 wherein said upper support member an upper horizontal head and a lower vertical neck such that said upper support member has a substantially T-shaped configuration.

10. The machine of claim 8 wherein said lower vertical neck of said upper support member is tubular and has a lower end and defines an interior passage open at said lower end such that said lower vertical neck is rotatably received over an upper end of said upright support member.

11. The machine of claim 9 wherein said upper end of said upper support rod of said upright support member extends into said interior passage of said lower vertical neck of said upper support member and abuts said upper horizontal head of said upper support member.

12. The machine of claim 9 wherein:

said upper horizontal head of said upper support member is tubular and has an end and defines an interior chamber open at said end thereof;

said inner end of said ball suspension rod is disposable through said open end and within said interior chamber of said upper horizontal head of said upper support member; and said upper support member has releasable securing means in the form of a pair of fasteners mounted to said upper horizontal head of said upper support member at spaced locations thereon and being rotatable in opposite directions and thereby movable toward and away from said inner end of said ball suspension rod between disengaged and engaged positions relative thereto such that in said disengaged position each fastener is loosened from said inner end of said ball suspension rod so that said ball suspension rod is free to be slidably moved horizontally within said interior chamber of said upper horizontal head of said upper support member to insert and remove the ball suspension rod and in said engaged position each fastener is tightened against said inner end of said ball suspension rod so that said inner end of said ball suspension rod is held stationarily in place within said interior chamber of said upper horizontal head of said upper support member.

13. The machine of claim 1 further comprising:

a base having a plurality of leg members which cross one another at a central location and for mounting on the surface, said lower end of said upright support member being mounted to said base at said central location thereon.

14. The machine of claim 13 wherein each of said leg members includes:

an inner bar;

an outer sleeve having an end and defining an interior cavity open at said end, said outer sleeve received over said inner bar such that said inner bar extends through said open end and within said interior cavity thereof; and a length adjustment device mounted to said outer sleeve and being rotatable in opposite directions and thereby movable toward and away from said inner bar between engaged and disengaged positions therewith such that in said disengaged position said length adjustment device is loosened relative to said inner bar so that said outer sleeve is free to be slidably moved horizontally over said inner bar so as to increase or decrease the overall length of said leg and in said engaged position said length adjustment device is tightened relative to said inner bar such that said outer sleeve is held stationary in place with respect to said inner bar so that a desired overall length of said leg is thereby maintained.

15. A self-training batting practice machine, comprising:

(a) a base for stationarily resting on a surface;

(b) an upright support member having an upper end and a lower end stationarily and non-rotatably mounted to said base such that said upright support member extends upwardly from and is mounted stationarily and non-rotatably on said base;

(c) an upper support member supported on said upper end of said upright support member such that said upper support member is rotatable relative to said upright support member about a pivot axis defined by said upright support member;

(d) a flexible ball suspension rod having an inner end and an outer end and being secured at said inner end thereof to and being rotatable with said upper support member and extending substantially horizontally outwardly from said upper support member, said outer end of said ball suspension rod having a substantially ball-shaped object thereon for a player to swing a bat at and to hit in order to practice batting; and (e) at least one elastic member disposed exteriorly of said upright support member and releasably attached to and stretchably extending between said base and said upper support member and extending along said upright support member generally between said upper and lower ends thereof and being disposed on the opposite side of said pivot axis from said ball suspension rod such that when said ball-shaped object on said outer end of said ball suspension rod is hit by the bat swung by the player said elastic member stretches and is at least partially wrappable about said upright support member so as to allow said upper support member and said ball suspension rod to rotate about said axis until the energy of the rotational motion is absorbed by said stretched and wrapped elastic member and the tension of said elastic member causes the rotation of said upper support member and said ball suspension rod to cease and said elastic member to unwrap from about said upright support member so as to cause said upper support member and said ball suspension rod to rotate in reverse about said axis.

16. The machine of claim 15 wherein:

said base has a plurality of leg members which cross one another at a central location and for mounting on the surface; and said lower end of said upright support member is mounted to said base at said central location thereon.

17. The machine of claim 16 wherein each of said plurality of leg members of said base includes:

an inner bar;

an outer sleeve having an end and defining an interior cavity open at said end, said outer sleeve received over said inner bar such that said inner bar extends through said open end and within said interior cavity thereof; and a length adjustment device mounted to said outer sleeve and being rotatable in opposite directions and thereby movable toward and away from said inner bar between engaged and disengaged positions therewith such that in said disengaged position said length adjustment device is loosened relative to said inner bar so that said outer sleeve is free to be slidably moved horizontally over said inner bar so as to increase or decrease the overall length of said lower support member and thereby the amount of resistance of said elastic member to the rotation of said upper support member and ball suspension rod about said axis as determined by the corresponding increase or decrease of distance at which said elastic member being connected to one of said legs of said base is away from said upright support member and in said engaged position said length adjustment device is tightened relative to said inner bar member such that said outer sleeve member is held stationary in place with respect to said inner bar so that a desired overall length of said leg of said base is thereby maintained.

18. The machine of claim 15 wherein said upright support member includes:

a lower tube having an open upper end and an interior cavity; and an upper support rod having an upper end and a lower end and being slidably inserted through said open upper end of said lower tube such that said lower end of said support rod is disposed within said interior cavity of said lower tube and said upper end of said upper support rod extends above said lower tubular member and mounts said upper support member.

19. The machine of claim 18 wherein said upright support member also includes a height adjustment device mounted to said lower tubular member adjacent to said open upper end thereof and being rotatable in opposite directions and thereby movable toward and away from said lower end of said upper support between engaged and disengaged positions therewith such that in said disengaged position said height adjustment device is loosened relative to said support rod so that said support rod is free to be slidably moved vertically within and with respect to said interior cavity of said lower tube for adjusting the height of said upper support member above the surface and in said engaged position said height adjustment device is tightened relative to said support rod so that said support rod is held stationary in place with respect to said lower tube.

20. The machine of claim 15 wherein:

said base has at least one hook element for attaching said elastic member to said lower support member; and said upper support member has a hook element for attaching said elastic member to said upper support member.

21. The machine of claim 15 wherein said at least one elastic member is an elastic cord.

22. The machine of claim 15 wherein:

said at least one elastic member is a plurality of elastic cords;

said base has a plurality of hooks each for attaching one of said elastic cords to said base; and said upper support member has a hook for attaching each of said elastic cords to said upper support member.

23. The machine of claim 15 wherein said upper support member an upper horizontal head and a lower vertical neck such that said upper support member has a substantially T-shaped configuration.

24. The machine of claim 23 wherein said lower vertical neck of said upper support member is tubular and has a lower end and defines an interior passage open at said lower end such that said lower vertical neck is rotatably received over an upper end of said upright support member.

25. The machine of claim 24 wherein said upper end of said upper support rod of said upright support member extends into said interior passage of said lower vertical neck of said upper support member and abuts said upper horizontal head of said upper support member.

26. The machine of claim 23 wherein:

said upper horizontal head of said upper support member is tubular and has an end and defines an interior chamber open at said end thereof;

said inner end of said ball suspension rod is disposable through said open end and within said interior chamber of said upper horizontal head of said upper support member; and said upper support member has releasable securing means in the form of a pair of fasteners mounted to said upper horizontal head of said upper support member at spaced locations thereon and being rotatable in opposite directions and thereby movable toward and away from said inner end of said ball suspension rod between disengaged and engaged positions relative thereto such that in said disengaged position each fastener is loosened from said inner end of said ball suspension rod so that said ball suspension rod is free to be slidably moved horizontally within said interior chamber of said upper horizontal head of said upper support member to insert and remove the ball suspension rod and in said engaged position each fastener is tightened against said inner end of said ball suspension rod so that said inner end of said ball suspension rod is held stationarily in place within said interior chamber of said upper horizontal head of said upper support member.

* * * * *